US008390182B2

(12) United States Patent
Yu

(10) Patent No.: US 8,390,182 B2
(45) Date of Patent: Mar. 5, 2013

(54) LIGHT EMITTING DIODE BULB

(75) Inventor: Hung-Ta Yu, New Taipei (TW)

(73) Assignee: AmTRAN TECHNOLOGY Co., Ltd., New Taipei (TW)

( * ) Notice: Subject to any disclaimer, the term of this patent is extended or adjusted under 35 U.S.C. 154(b) by 12 days.

(21) Appl. No.: 13/214,243

(22) Filed: Aug. 22, 2011

(65) Prior Publication Data

US 2012/0326589 A1 Dec. 27, 2012

(30) Foreign Application Priority Data

Jun. 24, 2011 (TW) ..... 100122277 A

(51) Int. Cl.
*H01J 1/02* (2006.01)
*H01J 7/24* (2006.01)

(52) U.S. Cl. ..... 313/46; 313/11; 313/567; 362/625

(58) Field of Classification Search ..... None
See application file for complete search history.

(56) References Cited

U.S. PATENT DOCUMENTS

| | | | | |
|---|---|---|---|---|
| 2009/0296387 | A1 * | 12/2009 | Reisenauer et al. | 362/235 |
| 2010/0002432 | A1 * | 1/2010 | Romano | 362/235 |
| 2010/0073944 | A1 | 3/2010 | Chen | |
| 2011/0080096 | A1 | 4/2011 | Dudik et al. | |
| 2011/0215699 | A1 * | 9/2011 | Le et al. | 313/46 |

* cited by examiner

*Primary Examiner* — Natalie Walford
(74) *Attorney, Agent, or Firm* — Jianq Chyun IP Office

(57) ABSTRACT

A light emitting diode bulb including a heat sink, a light source plate, a reflective frame and a secondary optical component is provided. The light source plate includes a circuit board disposed on the heat sink and a plurality of light emitting devices disposed on the circuit board. The reflective frame disposed on the light source plate includes a plate portion and a reflective pillar. The plate portion has a plurality of openings exposing the light emitting devices. The secondary optical component has a first optical surface and a second optical surface. An absolute value of the slope of a tangent line of any point on the first optical surface with respect to the heat sink is constant. An absolute value of the slope of a tangent line of any point on the second optical surface is gradually smaller along the direction away from the heat sink.

16 Claims, 12 Drawing Sheets

LIGHT EMITTING DIODE BULB

CROSS-REFERENCE TO RELATED APPLICATION

This application claims the priority benefit of Taiwan application serial no. 100122277, filed on Jun. 24, 2011. The entirety of the above-mentioned patent application is hereby incorporated by reference herein and made a part of this specification.

BACKGROUND OF THE INVENTION

1. Field of the Invention

The invention relates to a light source. More particularly, the invention relates to a light emitting diode (LED) bulb having uniform brightness.

2. Description of Related Art

The light emitting diode (LED) is extensively used in light bulbs, and such development matches the trend for low power consumption and environmental protection. However, since the LED has the light source output characteristics such as spot light source, high brightness, and narrow light beams, and considerations such as mechanical properties and product reliability for LED differ from traditional lamp products, countries all over the world are developing testing standards for fixture lighting including street lamps, outdoor illumination, interior lighting, etc.

There are few light emitting diode bulbs currently on the market that meet the standard for Energy Star. The main reason lies in that the LED itself provides light having strong directional property. That is, light from the LED is emitted in a certain direction. Furthermore, the position of the LED in the light bulb is affected and limited by the internal driving circuit and heat sink. In general, the light emitting angle of a high power LED for illumination is mostly 120 degrees. How to design an LED light bulb having a wide light emitting angle in terms of the structure and the optical design while still having a uniform and sufficient brightness is indeed a goal most manufacturers strive for.

FIG. 1A is a schematic view of a conventional LED bulb, and FIG. 1B is a schematic view of a light field distribution of the LED bulb shown in FIG. 1A. Referring to FIG. 1A and FIG. 1B, a lamp cover 110 of a conventional LED bulb 100 is usually semispherical. As such, when light provided by LEDs (not shown) in the bulb 100 passes through the lamp cover and is emitted from the bulb 100, the distribution of the light field is overly concentrated in the center such that the uniformity and the light emitting angle is not ideal.

SUMMARY OF THE INVENTION

The invention provides a light emitting diode (LED) bulb which has a better heat dissipating structure and an illumination area with a wider angle and more uniformity.

Other objects and advantages of the invention can be further illustrated by the technical features broadly embodied and described as follows.

To achieve one, some, or all the above purposes or other objectives, an embodiment of the invention provides an LED bulb including a heat sink, a light source plate, a reflective frame, and a secondary optical component. The light source plate is disposed on the heat sink and includes a circuit board and a plurality of light emitting devices. The circuit board is disposed on the heat sink, and the light emitting devices are disposed on the circuit board. The reflective frame is disposed on the light source plate. The reflective frame includes a plate portion and a reflective pillar. The plate portion is disposed on the circuit board and has a plurality of openings to expose the light emitting devices. The reflective pillar is disposed on the plate portion and is physically connected to the plate portion. The secondary optical component covers the light source plate and the reflective frame and is physically connected to the heat sink. The secondary optical component is doped with a plurality of diffusing particles and has a first optical surface and a second optical surface. The first optical surface connects the heat sink and the second optical surface. An absolute value of a slope of a tangent line of any point on the first optical surface with respect to the heat sink is substantially constant, and an absolute value of a slope of a tangent line of any point on the second optical surface is gradually smaller along a direction away from the heat sink.

According to an embodiment of the invention, the heat sink has a plurality of first heat dissipating fins. The first heat dissipating fins cover a part of the first optical surface.

In an embodiment of the invention, each of the light emitting devices is suitable for providing a light beam. Some of the light beams are directly transmitted to the reflective frame, then reflected by the reflective pillar to the secondary optical component, and emitted from the LED bulb. Some of the light beams are directly transmitted to the secondary optical component and emitted from the LED bulb.

According to an embodiment of the invention, a material of the reflective frame is a heat conducting material.

According to an embodiment of the invention, the LED bulb further includes a heat dissipating component disposed on the secondary optical component. The heat dissipating component has a locking opening and a plurality of second heat dissipating fins. The second heat dissipating fins cover a part of the second optical surface.

According to an embodiment of the invention, the LED bulb further includes a locking component passing though the locking opening of the heat dissipating component and locked into a screw opening of the reflective pillar such that the heat dissipating component is fixed onto the secondary optical component.

According to an embodiment of the invention, the LED bulb further includes a top cover disposed on the locking opening of the heat dissipating component to cover the locking component.

In an embodiment of the invention, the reflective pillar is a hollow pillar.

According to an embodiment of the invention, the LED bulb further includes a heat conducting component disposed in the reflective pillar.

In an embodiment of the invention, an angle between a tangent line of any point on the first optical surface and the heat sink is substantially larger than 90 degrees and smaller than 180 degrees. In an embodiment of the invention, the angle is substantially between 116 degrees and 146 degrees.

According to an embodiment of the invention, the secondary optical component further has a flat surface. A slope of the flat surface with respect to the heat sink is 0. The flat surface is disposed directly on the circuit board and is connected to the second optical surface.

According to an embodiment of the invention, the secondary optical component further includes a plurality of locking portions for locking with the heat sink such that the secondary optical component is fixed onto the heat sink.

In an embodiment of the invention, the secondary optical component is formed by a plurality of sub-optical devices locked with one another.

According to an embodiment of the invention, the LED bulb further includes a driving device frame connected to a bottom of the heat sink. The driving device frame is for disposing a driving circuit electrically connected to the light source plate.

According to an embodiment of the invention, the LED bulb further includes a screw lamp head, wherein a part of the driving device frame is locked in the screw lamp head, and the driving circuit is electrically connected to the screw lamp head.

According to an embodiment of the invention, the driving circuit is an AC to DC driving circuit.

Another embodiment of the invention provides an LED bulb including a heat sink, a light source plate, a reflective frame, and a secondary optical component. The light source plate is disposed on the heat sink and includes a circuit board and a plurality of light emitting devices. The circuit board is disposed on the heat sink, and the light emitting devices are disposed on the circuit board. The reflective frame is disposed on the light source plate and includes a plate portion and reflective pillar. The plate portion is disposed on the circuit board and has a plurality of openings to expose the light emitting devices. The reflective pillar is disposed on the plate portion and is physically connected to the plate portion. The secondary optical component covers the light source plate and the reflective frame and is physically connected to the heat sink. The secondary optical component is doped with a plurality of diffusing particles and has a first optical surface and a second optical surface. The first optical surface connects the heat sink and the second optical surface. An absolute value of a slope of a tangent line of any point on the first optical surface with respect to the heat sink is substantially constant, and an absolute value of a slope of a tangent line of any point on the second optical surface is gradually larger and then gradually smaller along a direction away from the heat sink.

In view of the above, the embodiments of the invention achieve at least the following advantages or efficacies. The LED bulb is an omnidirectional device using a secondary optical component to reach a wide angle of illumination. An absolute value of a slope of a tangent line of any point on a first optical surface of the secondary optical component with respect to the heat sink is substantially constant, and an absolute value of a slope of a tangent line of any point on the second optical surface is gradually smaller along the direction away from the heat sink. In addition, as the secondary optical component is doped with a plurality of diffusing particles, light beams can be emitted for the LED bulb not only by refraction but also by diffusion/irradiation, thereby providing an illumination area with better uniformity and a wider angle. Moreover, since the reflective pillar next to the light emitting device also assists in reflecting some of the light beams to the secondary optical component, the LED bulb is thus further capable of providing an illumination area with better uniformity and a wider angle.

In order to make the aforementioned and other features and advantages of the invention more comprehensible, embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

It is to be understood that the foregoing and other detailed descriptions, features, and advantages are intended to be described more comprehensively by providing embodiments accompanied with figures hereinafter. In the following embodiments, wordings used to indicate directions, such as "up," "down," "front," "back," "left," and "right", merely refer to directions in the accompanying drawings. Therefore, the directional wording is used to illustrate rather than limit the invention.

Figure 1A:
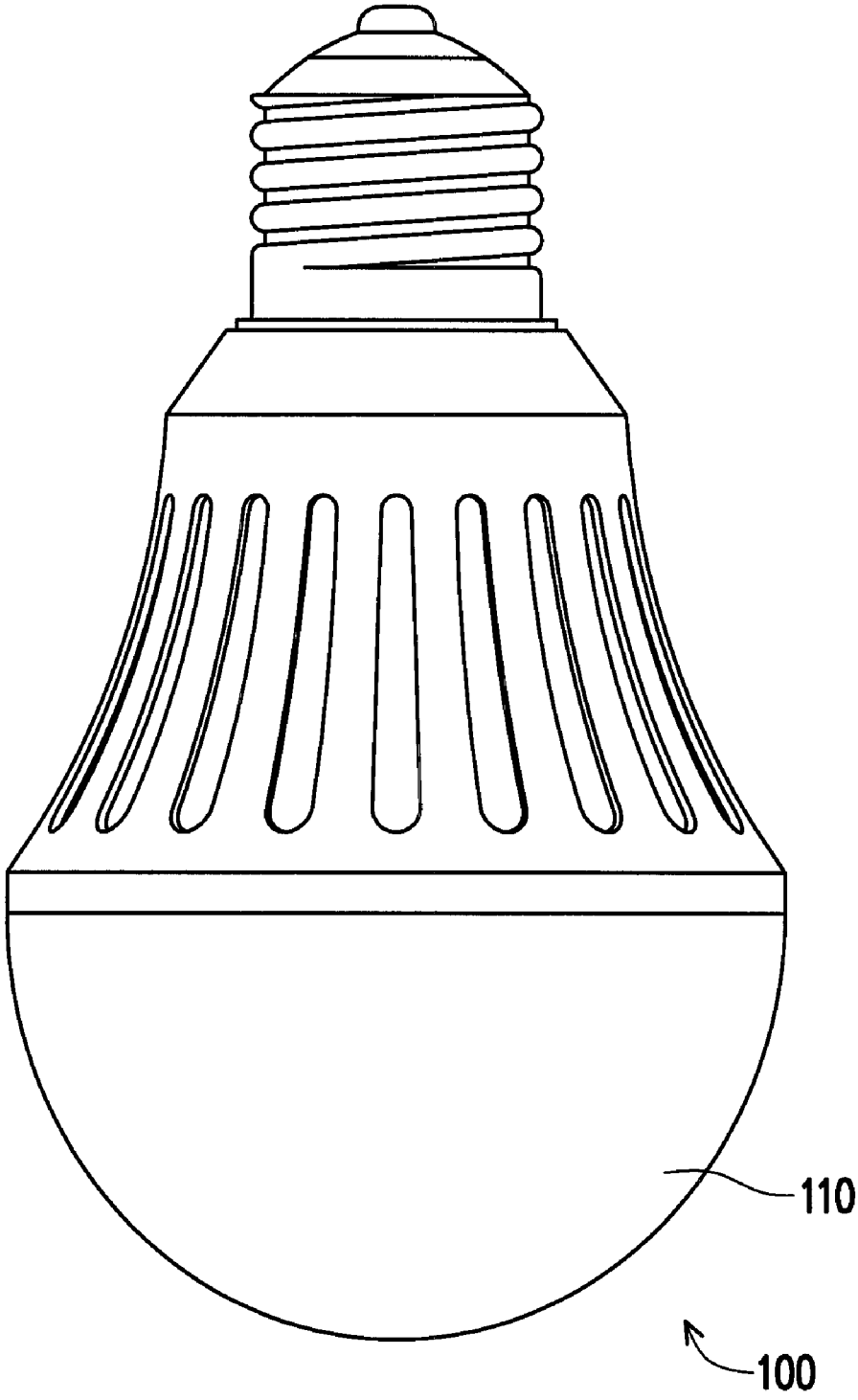
FIG. 1A(RELATED ART)
FIG. 1A illustrates a schematic view of a conventional LED bulb.
Figure 1B:
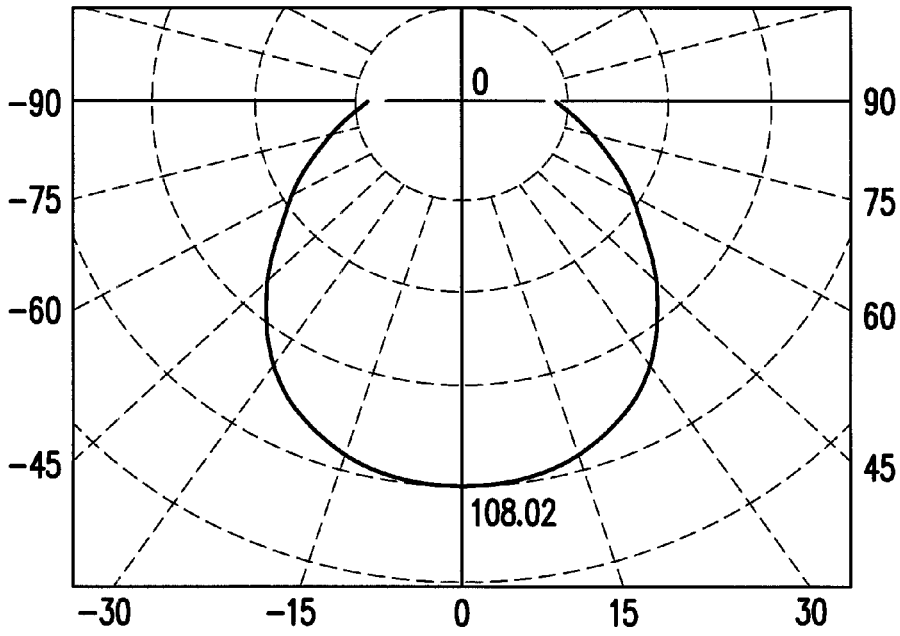
FIG. 1B(RELATED ART)
FIG. 1B is a schematic view of a light field distribution of the LED bulb shown in FIG. 1A.
Figure 2A:
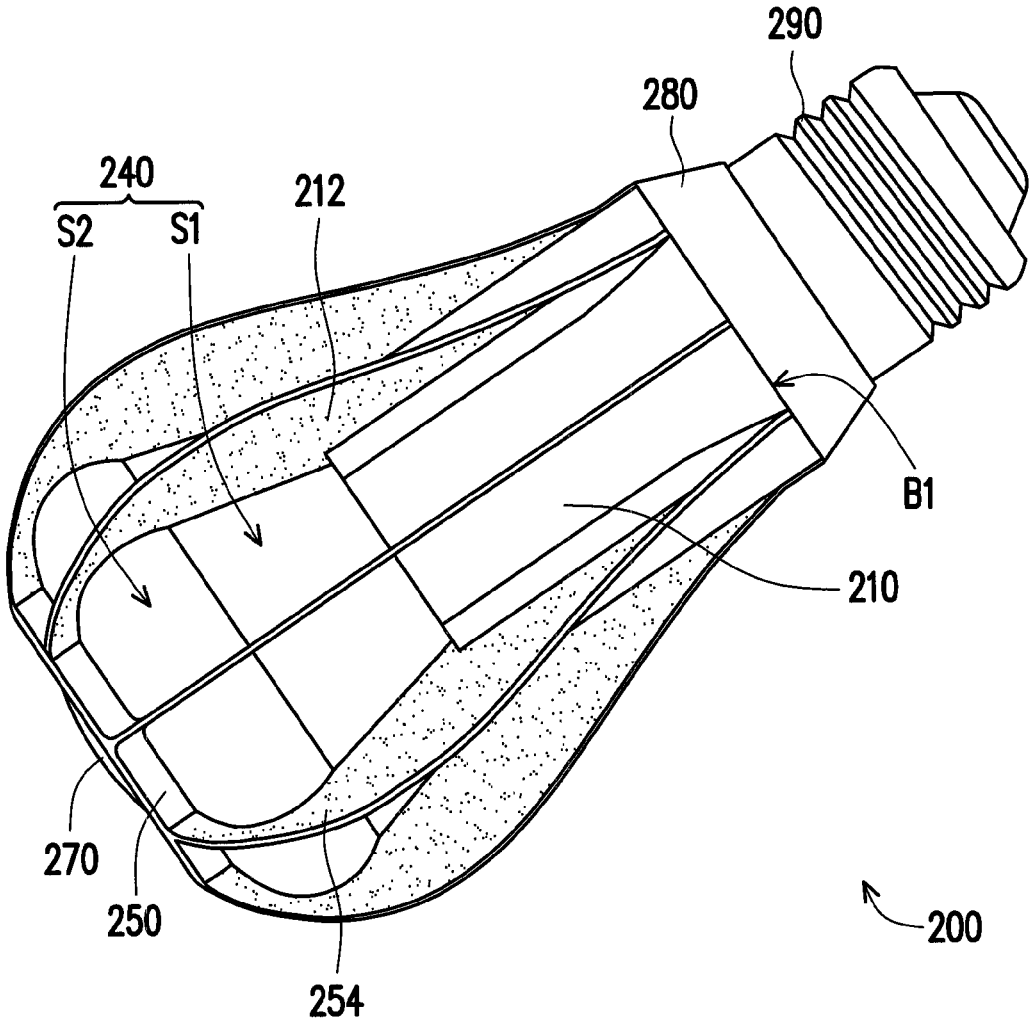
FIG. 2A is a schematic perspective view of an LED bulb according to an embodiment of the invention.
Figure 2B:
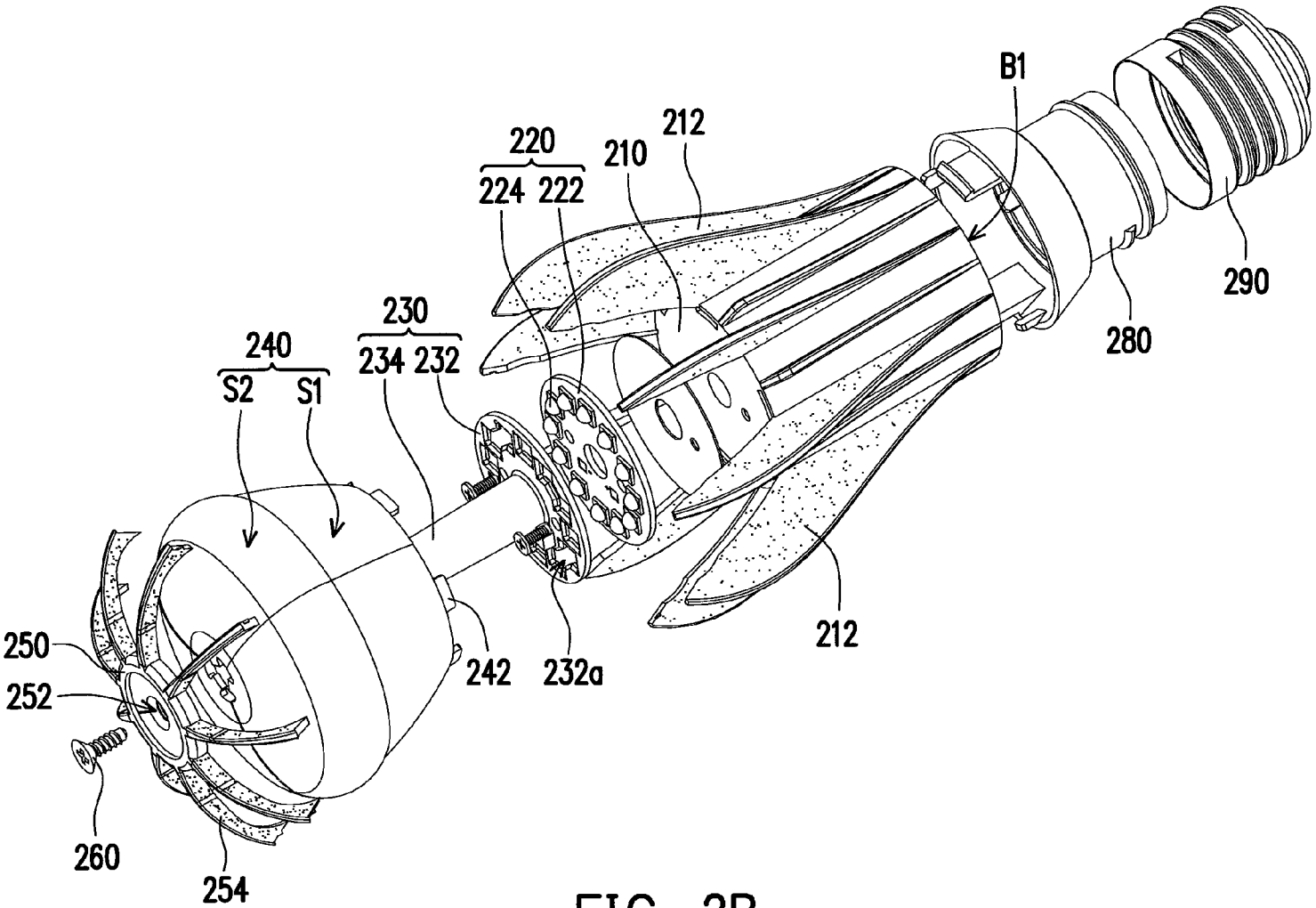
FIG. 2B illustrates a schematic breakdown view of the LED bulb shown in FIG. 2A.
Figure 3A:
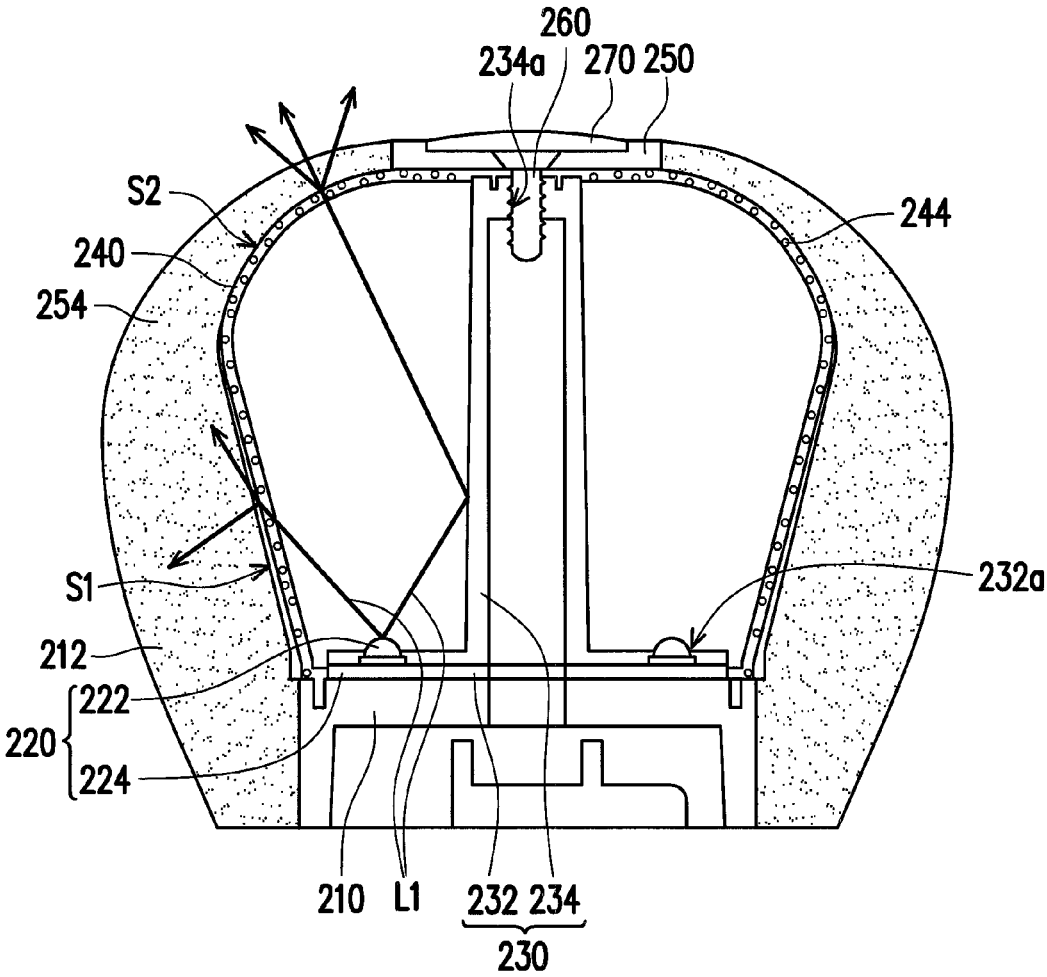
FIG. 3A illustrates a partial schematic cross-sectional view showing the progression of light beams of the LED bulb in FIG. 2A.
Figure 3B:
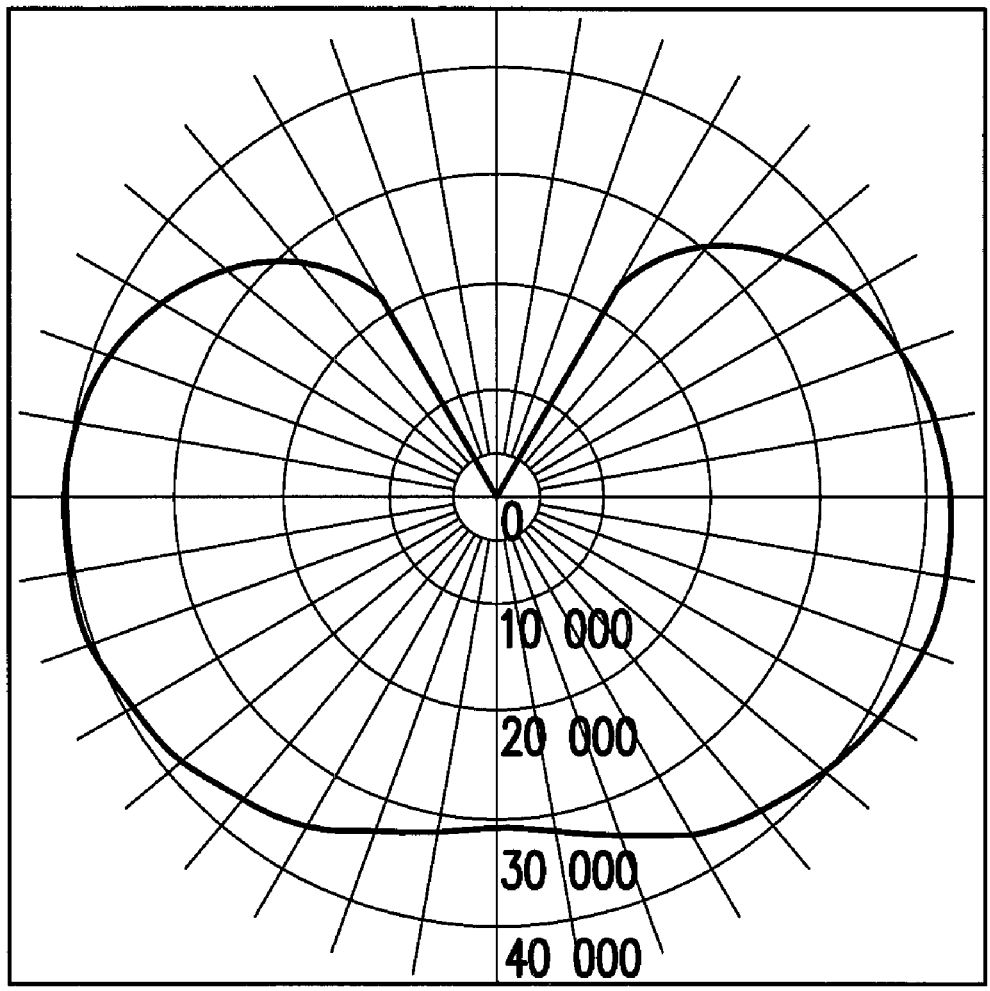
FIG. 3B is a schematic view of a light field distribution of the LED bulb shown in FIG. 2A.

FIG. 2A is a schematic perspective view of an LED bulb according to an embodiment of the invention. FIG. 2B is a schematic breakdown view of the LED bulb shown in FIG. 2A. FIG. 3A illustrates a partial schematic cross-sectional view showing the progression of light beams of the LED bulb in FIG. 2A. FIG. 3B is a schematic view of a light field distribution of the LED bulb shown in FIG. 2A. Referring to FIG. 2A, FIG. 2B, FIG. 3A, and FIG. 3B at the same time, a light emitting diode (LED) bulb 200 of the present embodiment includes a heat sink 210, a light source plate 220, a reflective frame 230, and a secondary optical component 240. The light source plate 220 is disposed on the heat sink 210 and includes a circuit board 222 and a plurality of light emitting devices 224. The circuit board 222 is disposed on the heat sink 210, and the light emitting devices 224 are disposed on the circuit board 222. In the present embodiment, the heat sink 210 may use a heat dissipating material having a high thermal conductivity coefficient. As such, the heat generated from driving the light source plate 220 is effectively dissipated to the outside by the heat sink 210. To increase the heat dissipating effects of the LED bulb 200, the heat sink 210 of the present embodiment further has a plurality of first heat dissipating fins 212. The first heat dissipating fins 212 cover part of the secondary optical component 240.

Specifically, as the heat sink 210 has a plurality of first heat dissipating fins 212, the overall area for heat dissipation of the heat sink 210 is significantly increased and thereby the heat generated from the light source plate 220 is effectively dissipated outside the LED bulb 200 by way of conduction. As such, the light source plate 220 can easily have a longer usage life under normal work temperatures. In other words, in the present embodiment, the use of the first heat dissipating fins 212 effectively enhances heat dissipation of the LED bulb 200. Moreover, to further increase the overall heat dissipation of the LED bulb 200, the material of the circuit board 222 of the light source plate 220 may be a conductive substrate having good heat conductivity. That is, a metal core printed circuit board (MCPCB), a ceramic substrate or other appropriate circuit boards with good thermal conductivity coefficients may be selected for the circuit board 222. The materials listed herein are for illustration purposes and the materials for the circuit board 222 are not limited thereto. In the present embodiment, the light emitting devices 224 are, for example, light emitting diode devices, and each of the light emitting devices 224 provides a light beam L1.

Continuingly referring to FIG. 2A, FIG. 2B, and FIG. 3A, the reflective frame 230 is disposed on the light source plate 220 and includes a plate portion 232 and a reflective pillar 234. Specifically, the plate portion 232 is disposed on the circuit board 222 and has a plurality of openings 232*a* to expose the light emitting devices 224, as shown in FIG. 2B and FIG. 3A. Furthermore, the reflective pillar 234 is disposed on the plate portion 232 and is physically connected to the plate portion 232. In the present embodiment, because the light beam L1 provided by the light emitting device 224 is strongly directional, the LED bulb 200 can reflect part of the light beam L1 through the reflective pillar 234 next to the light emitting device 224. Thereby, when the light beam L1 is emitted from the LED bulb 200, there is better light uniformity. Furthermore, in addition to reflecting the light beam L1, the reflective frame 230 can effectively enhance heat dissipation of the LED bulb 200 if the reflective frame is properly selected. In the present embodiment, the reflective pillar 234 is a hollow pillar.

In the LED bulb 200, the plate portion 232 of the reflective frame 230 fixes the light source plate 220 through the opening 232*a* and directly contacts the light source plate 220. Thus, if the material of the reflective frame 230 is selected to be a heat conductive material having a high thermal conductivity coefficient, the heat generated from the light source plate 220 not only can be dissipated through the heat sink 210 but also can be transmitted to the plate portion 232 and the reflective pillar 234 for dissipation. Similarly, to effectively conduct the heat transmitted to the plate portion 232 and the reflective pillar 234 outside the LED bulb to enhance heat dissipation, the LED bulb 200 further includes a heat dissipating component 250 and a locking component 260, wherein the heat dissipating component 250 is disposed on the secondary optical component 240 and has a locking opening 252 and a plurality of second heat dissipating fins 254, and the locking component 260 is connected to the reflective pillar 234 through the locking opening 252 of the heat dissipating component 250, as shown in FIG. 2B and FIG. 3A.

Specifically, the locking component 260 is fixed to a screw opening 234*a* of the reflective pillar 234 through the locking opening 252 of the heat dissipating component 250 such that the heat dissipating component 250 is fixed to the secondary optical component 240 and contacts the reflective pillar 234. When the locking component 260 is of a material having good heat conducting property, in addition to effectively fixing the heat dissipating component 250 to the secondary optical component 240, the locking component 260 helps effectively conduct the heat transmitted to the plate portion 232 and the reflective pillar 234 to the heat dissipating component 250, thereby dissipating heat through the second heat dissipating fins 254. The second heat dissipating fins 254 cover part of the secondary optical component 240, as shown in FIG. 2A, FIG. 2B, and FIG. 3A. In the present embodiment, the first heat dissipating fins 212 and the second heat dissipating fins 254 are in contact and form a heat dissipation and circulation system, as shown in FIG. 2A. However, in other embodiments, the first heat dissipating fins 212 and the second heat dissipating fins 254 may be not in contact. The above is for illustration purpose and the invention is not limited thereto.

Continuingly referring to FIG. 2A, FIG. 2B, and FIG. 3A, the secondary optical component 240 covers the light source plate 220 and the reflective frame 230 and is physically connected to the heat sink 210. In specific, the secondary optical component 240 has a first optical surface S1 and a second optical surface S2, wherein the first optical surface S1 connects the heat sink 210 and the second optical surface S2. In particular, an absolute value of a slope of a tangent line of any point on the first optical surface S1 with respect to the heat sink 210 is substantially constant, and an absolute value of a slope of a tangent line of any point on the second optical surface S2 is gradually smaller along the direction away from the heat sink 210. As such, some of light beams L1 from the light emitting devices 224 are effectively refracted and emitted, outside the LED bulb 200 when transmitted to the first optical surface S1 and the second optical surface S2, such that the LED bulb 200 provides a uniform light field distribution with a wide angle.

In the LED bulb 200, in the present embodiment, the secondary optical component 240 is doped with a plurality of diffusing particles 244. As such, the light beams L1 can be emitted outside the LED bulb 200 not only by refraction but also by diffusion/irradiation (as shown in FIG. 3A), thereby providing an illumination area with a wider angle, i.e. omnidirectional illumination, as the light field distribution shown in FIG. 3B. From FIG. 3B, the LED bulb 200 of the present embodiment can achieve omnidirectional illumination by changing the transmission path of the light beams L1 through the reflective frame 230 and the secondary optical component. For example, the illumination angle of the LED bulb 200 of the present embodiment can reach 309 degrees and the light uniformity in this illumination angle is in the range of 0.78~0.8. In other words, compared to conventional LED light bulbs/light sources having an illumination angle of 286 degrees and light uniformity of 0.4~0.6, the LED bulb 200 of the present embodiment indeed has an illumination area with a wider angle and a light field distribution with better light uniformity.

Figure 4A:
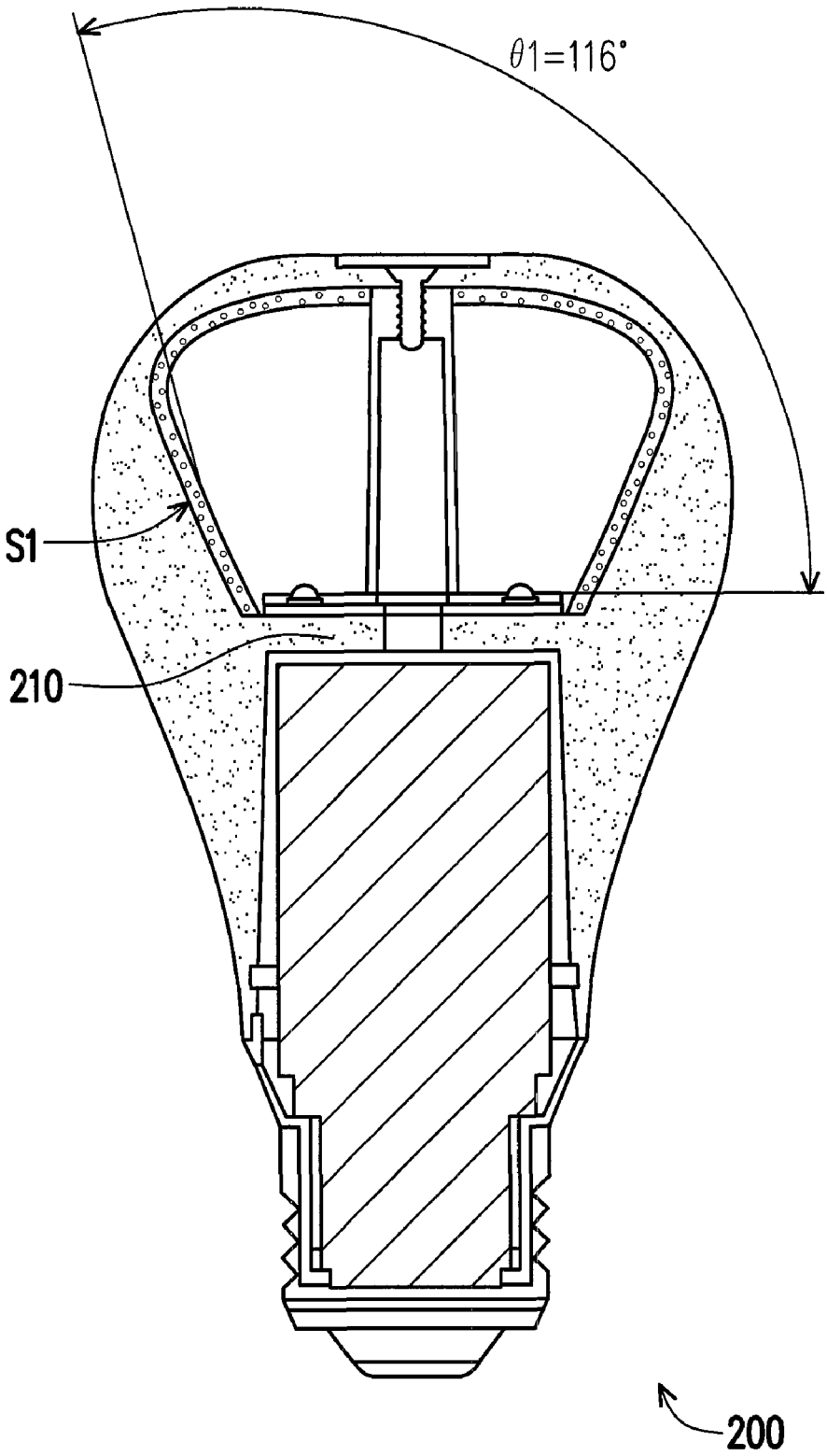
FIG. 4A and FIG. 4B illustrate schematic cross-sectional views of the LED bulb when the angles are 116 degrees and 146 degrees respectively.
Figure 4B:
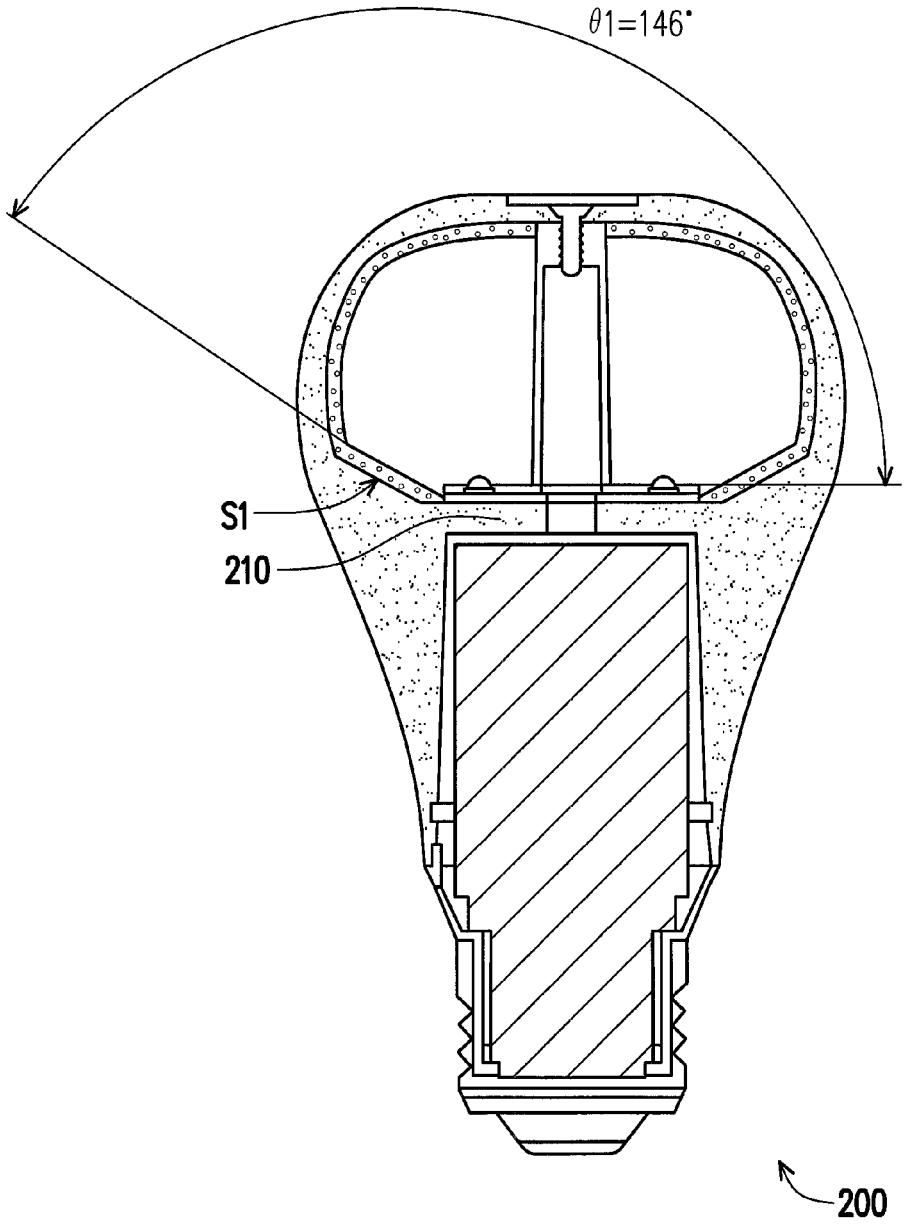

In the LED bulb 200 shown in FIG. 2A and FIG. 3A, a tangent line of any point on the first optical surface S1 forms an angle θ1 with the heat sink 210, wherein θ1 is substantially larger than 90 degrees and smaller than 180 degrees, and more preferably, between 116 degrees and 146 degrees, as shown in FIG. 4A and FIG. 4B, illustrating cross-sectional schematic views of the LED bulb with the angle being 116 degrees and 146 degrees, respectively. In the present embodiment, if the angle θ1 falls between 116 degrees and 146 degrees, the LED bulb 200 can present the light field distribution as shown in FIG. 3B; that is, an illumination area having a wider angle and better light uniformity.

Figure 5A:
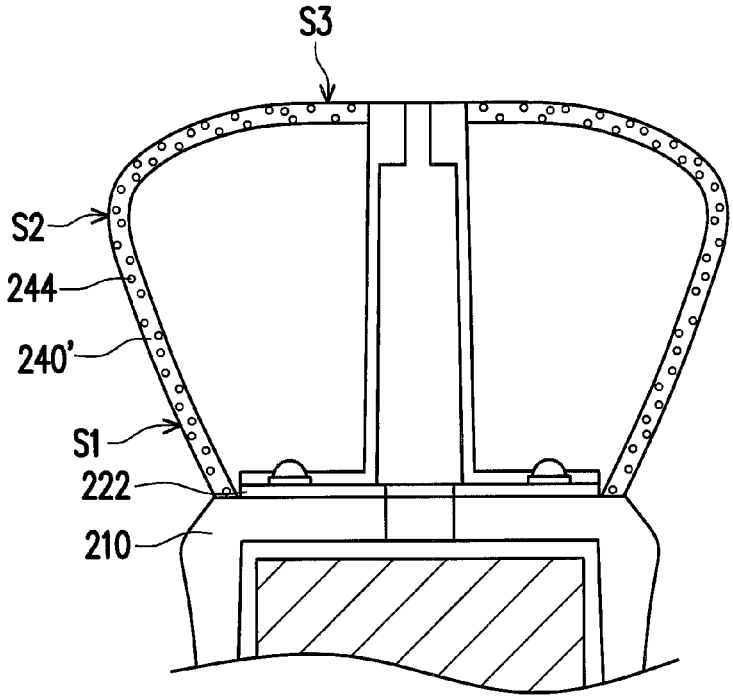
FIG. 5A to FIG. 5C are schematic views of the secondary optical component according to different embodiments.
Figure 5B:
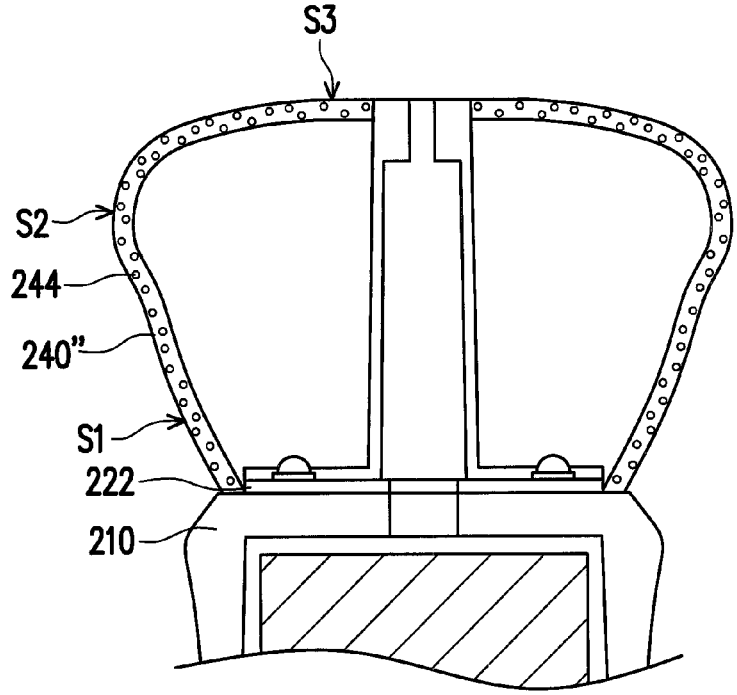
Figure 5C:
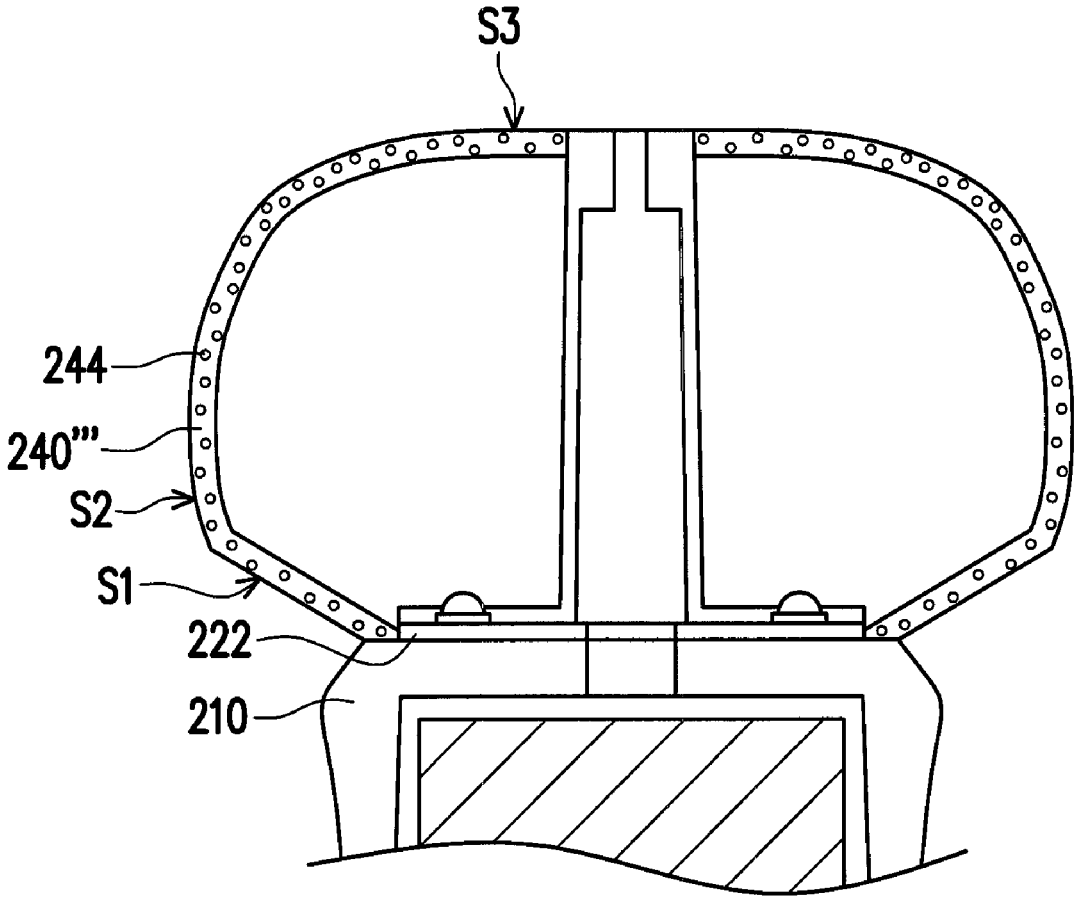

Additionally, the secondary optical component 240 may adopt the embodiments of the secondary optical components 240', 240", and 240'" shown in FIGS. 5A~5C, but is not limited thereto. In detail, in FIG. 5A, the secondary optical component 240' has a surface S3, wherein a slope of the surface S3 with respect to the heat sink 210 is 0. In other words, the surface S3 is parallel to the heat sink 210 and the surface S3 is directly above the circuit board 222 and is connected to the second optical surface S2, as shown in FIG. 5A. In FIG. 5B, the secondary optical component 240" can have the surface S3. Furthermore, an absolute value of a slope of a tangent line of any point on the second optical surface S2 with respect to the heat sink 210 is gradually larger and then gradually smaller along the direction away from the heat sink 210. In FIG. 5C, the secondary optical component 240'"

adopts the embodiment of the secondary optical component 240". However, the difference is that an angle between a tangent line of any point on a first optical surface S1 of the secondary optical component 240'" and the heat sink 210 is larger than an angle between a tangent line of any point on a first optical surface S1 of the secondary optical component 240" and the heat sink 210, as shown in FIG. 5B and FIG. 5C. It should be noted that the above illustrates embodiments of the secondary optical component 240, which are not limited thereto, however.

Figure 6:
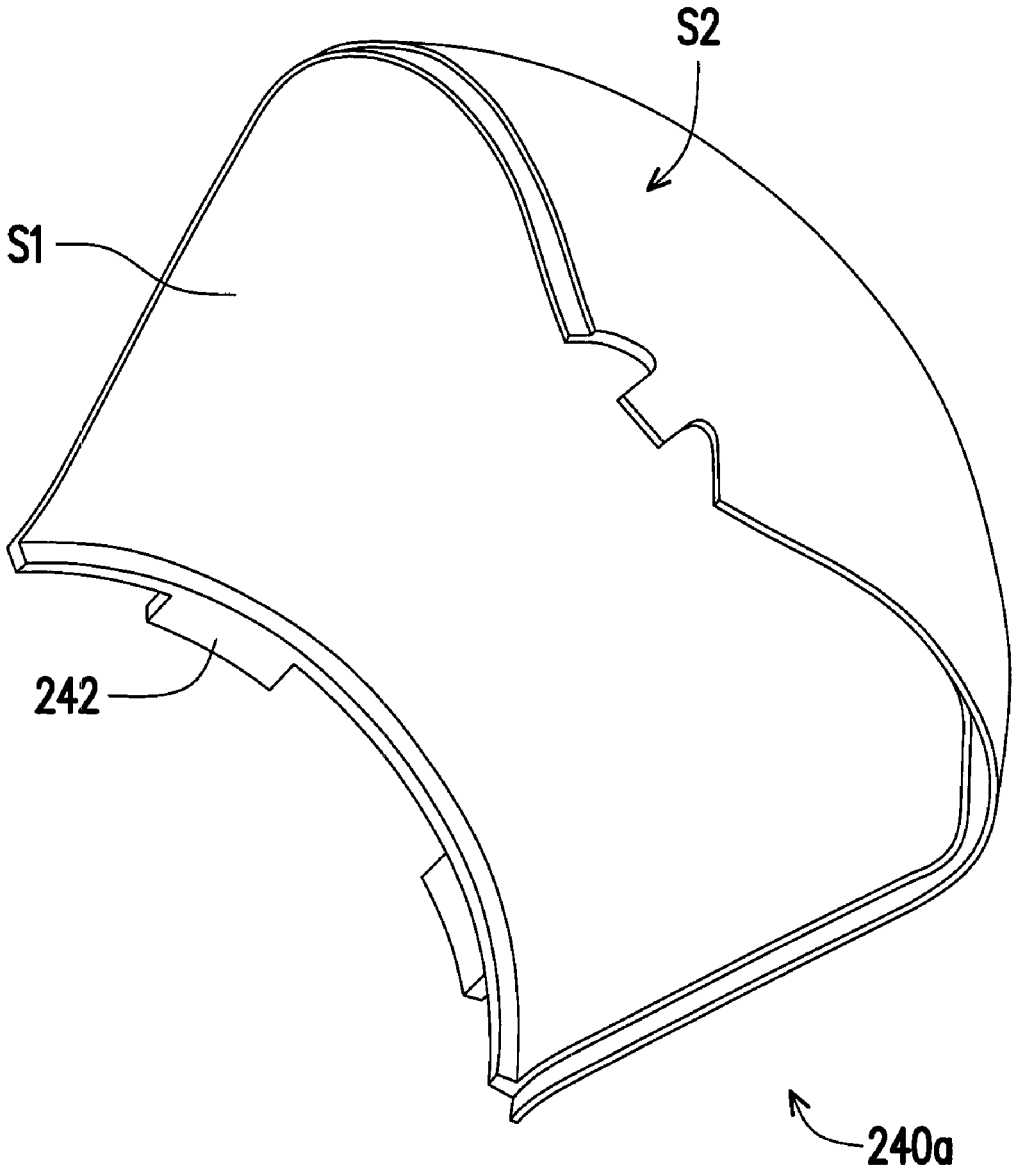
FIG. 6 illustrates a schematic view of a sub-optical device of the secondary optical component.

Furthermore, the secondary optical components 240, 240', 240", and 240'" may also be formed with a plurality of sub-optical components 240*a* locked with one another as shown in FIG. 6 or may be formed as an integral structure. In detail, the secondary optical components 240, 240', 240", and 240'" may be formed with two, three, four, or other numbers of sub-optical components 240*a* locked with one another as the embodiments illustrated in FIG. 2B and FIGS. 5A~5C. In another embodiment, the secondary optical components 240, 240', 240", and 240'" may be formed integrally. That is, the secondary optical component can be formed by way of pressing, press molding, cast molding, etc.

Continuingly referring to FIG. 2A, FIG. 2B, and FIG. 3A, the secondary optical component 240 further includes a plurality of locking portions 242 for fixing with the heat sink 210 such that the secondary optical component 240 is fixed on the heat sink 210. Furthermore, the LED bulb 200 further includes a driving device frame 280 connected to a bottom B1 of the heat sink 210. The driving device frame 280 is suitable for disposing a driving circuit therein (not shown), and the driving circuit is electrically connected to the light source plate 220. In the present embodiment, the LED bulb 200 further includes a screw lamp head 290, wherein a part of the driving device frame 280 is locked in the screw lamp head 290, and the driving circuit 282 is electrically connected to the screw lamp head 290, as shown in FIG. 2A, FIG. 2B, and FIG. 3A. In the present embodiment, the driving circuit is mainly for converting the alternating current signal applied to the shrew lamp head 290 to a direct current signal to be provided for use by the light source plate 220.

In addition, the LED bulb 200 may also include a top cover 270 disposed on the locking opening 252 of the heat dissipating component 250 to cover the locking component 260 to protect the locking component 260 from rusting resulted from being exposed outside and also to provide an esthetic effect.

Figure 7:
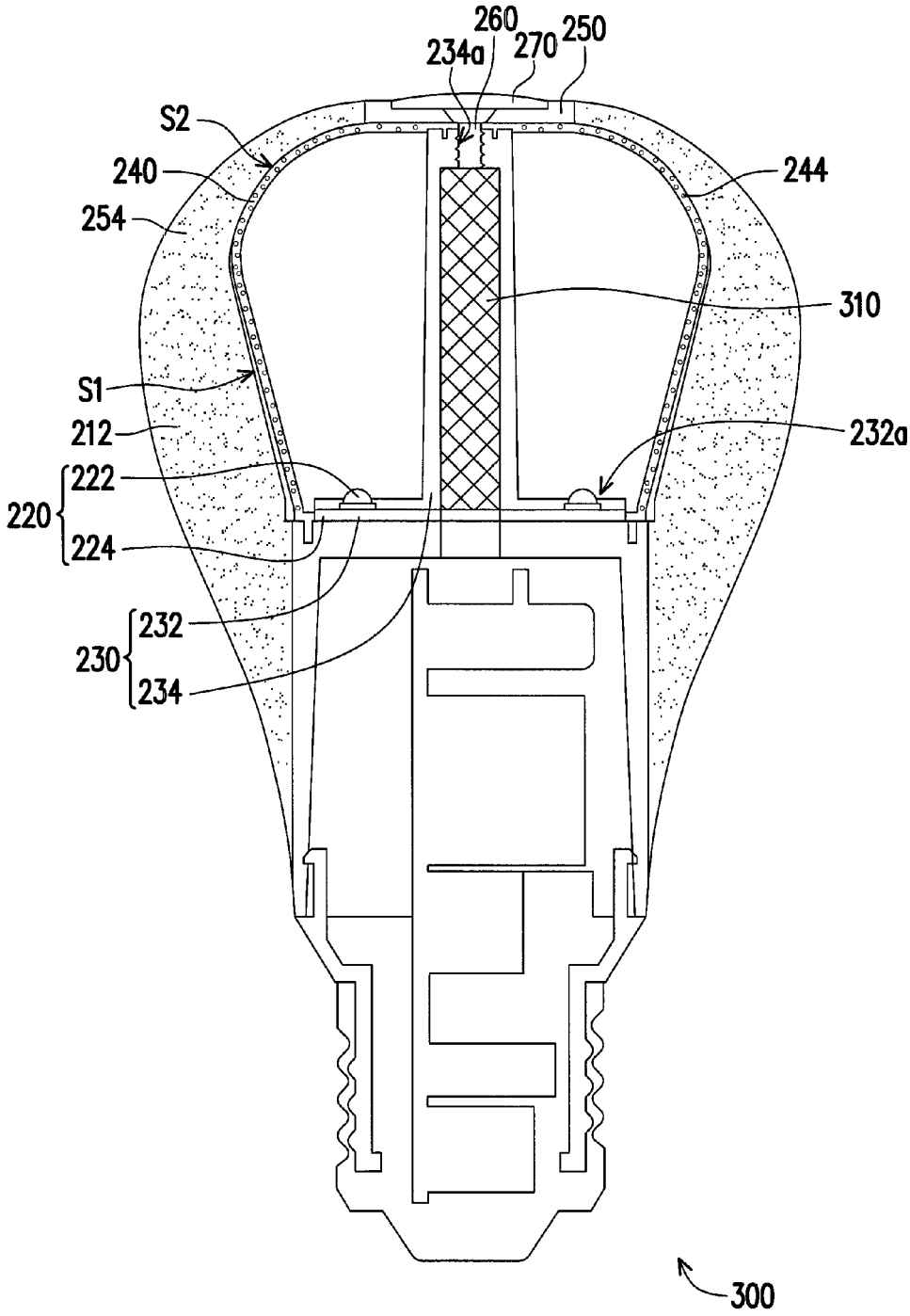
FIG. 7 is a schematic cross-sectional view of an LED bulb according to another embodiment of the invention.

FIG. 7 is a schematic cross-sectional view of an LED bulb according to another embodiment of the invention. Referring to FIG. 7, an LED bulb 300 of the present embodiment adopts the same concept as the LED bulb 200 described above with a difference being that the LED bulb 300 includes a heat conducting component 310 disposed in the reflective pillar 234, as shown in FIG. 7. In general, thermal conduction efficiency of a solid matter is higher than that of liquid or gas. As such, by disposing the heat conducting component 310 in the reflective pillar 234, the heat generated from the light source plate 220 is further transmitted outside the LED bulb 300 at a higher speed, thereby increasing the heat dissipation effect.

In summary, the LED bulb of the invention has at least the following advantages. First of all, the LED bulb is an omni-directional device using a secondary optical component to reach a wide angle of illumination. An absolute value of a slope of a tangent line of any point on a first optical surface of the secondary optical component with respect to the heat sink is substantially constant, and an absolute value of a slope of a tangent line of any point on a second optical surface is gradually smaller along the direction away from the heat sink. In addition, as the secondary optical component is doped with a plurality of diffusing particles, light beams can be emitted from the LED bulb not only by refraction but also by diffusion/irradiation, thereby providing an illumination area with better light uniformity and a wider angle. Moreover, since the reflective pillar next to the light emitting device also assists in reflecting some of the light beams to the secondary optical component, the LED bulb is thus further capable of providing an illumination area with better light uniformity and a wider angle. Also, as the heat sink has a plurality of first heat dissipating fins, and the heat dissipating component has a plurality of second heat dissipating fins, the overall area for heat dissipation of the LED bulb is increased and thereby the heat generated from the light source plate is effectively dissipated outside the LED bulb by way of conduction. As such, the light source plate can have a longer usage life. In other words, in the present embodiment, the use of the first heat dissipating fins and the second heat dissipating fins effectively enhances heat dissipation of the LED bulb.

The embodiments described hereinbefore are chosen and described in order to best explain the principles of the invention and its best mode practical application. It is not intended to be exhaustive to limit the invention to the precise form or to the exemplary embodiments disclosed. Namely, persons skilled in the art are enabled to understand the invention through various embodiments with various modifications as are suited to the particular use or implementation contemplated. It is intended that the scope of the invention be defined by the claims appended hereto and their equivalents in which all terms are meant in their broadest reasonable sense unless otherwise indicated. Any of the embodiments or any of the claims of the invention does not need to achieve all of the advantages or features disclosed by the invention. Moreover, the abstract and the headings are merely used to aid in searches of patent files and are not intended to limit the scope of the claims of the invention.

The invention claimed is:

1. A light emitting diode bulb, comprising:

a heat sink;

a light source plate disposed on the heat sink, the light source plate comprising:

a circuit board disposed on the heat sink; and a plurality of light emitting devices disposed on the circuit board;

a reflective frame disposed on the light source plate, the reflective frame comprising:

a plate portion disposed on the circuit board and having a plurality of openings to expose the light emitting devices; and a reflective pillar disposed on the plate portion and physically connected to the plate portion; and a secondary optical component covering the light source plate and the reflective frame and physically connected to the heat sink, wherein the reflective pillar of the reflective frame is connected to the secondary optical component, the secondary optical component is doped with a plurality of diffusion particles and has a first optical surface and a second optical surface, the first optical surface connects the heat sink and the second optical surface, an absolute value of a slope of a tangent line of any point on the first optical surface with respect to the heat sink is substantially constant, and an absolute value of a slope of a tangent line of any point on the second optical surface is gradually smaller along a direction away from the heat sink.

2. The light emitting diode bulb according to claim 1, wherein the heat sink has a plurality of first heat dissipating fins covering a part of the first optical surface.

3. The light emitting diode bulb according to claim 1, wherein each of the light emitting devices is suitable for providing a light beam, a part of the light beam is directly transmitted to the reflective frame, reflected by the reflective pillar to the secondary optical component, and then emitted from the LED bulb, and another part of the light beam is suitable for directly transmitted to the secondary optical component and emitted from the LED bulb.

4. The light emitting diode bulb according to claim 1, wherein a material of the reflective frame is a heat conducting material.

5. The light emitting diode bulb according to claim 1, further comprising a heat dissipating component disposed on the secondary optical component, wherein the heat dissipating component has a locking opening and a plurality of second heat dissipating fins covering a part of the second optical surface.

6. The light emitting diode bulb according to claim 5, further comprising a locking component passing though the locking opening of the heat dissipating component and locked into a screw opening of the reflective pillar such that the heat dissipating component is fixed onto the secondary optical component.

7. The light emitting diode bulb according to claim 6, further comprising a top cover disposed on the locking opening of the heat dissipating component to cover the locking component.

8. The light emitting diode bulb according to claim 1, wherein the reflective pillar is a hollow pillar.

9. The light emitting diode bulb according to claim 8, further comprising a heat conducting component disposed in the reflective pillar.

10. The light emitting diode bulb according to claim 1, wherein an angle between the tangent line of any point on the first optical surface and the heat sink is substantially greater than 90 degrees and smaller than 180 degrees.

11. The light emitting diode bulb according to claim 10, wherein the angle is substantially in a range between 116 degrees and 146 degrees.

12. The light emitting diode bulb according to claim 1, wherein the secondary optical component further has a flat surface, a slope of the flat surface with respect to the heat sink is 0, and the flat surface is disposed directly on the circuit board and is connected to the second optical surface.

13. The light emitting diode bulb according to claim 1, wherein the secondary optical component further comprises a plurality of locking portions for locking with the heat sink such that the secondary optical component is fixed on the heat sink.

14. The light emitting diode bulb according to claim 1, wherein the secondary optical component comprises a plurality of sub-optical devices locked with one another.

15. The light emitting diode bulb according to claim 1, further comprises a driving device frame connected to a bottom of the heat sink, wherein the driving device frame is suitable for disposing a driving circuit therein, and the driving circuit is electrically connected to the light source plate.

16. A light emitting diode bulb, comprising:

a heat sink;

a light source plate disposed on the heat sink, the light source plate comprising:

a circuit board disposed on the heat sink; and a plurality of light emitting devices disposed on the circuit board;

a reflective frame disposed on the light source plate, the reflective frame comprising:

a plate portion disposed on the circuit board and having a plurality of openings to expose the light emitting devices; and a reflective pillar disposed on the plate portion and physically connected to the plate portion; and a secondary optical component, covering the light source plate and the reflective frame and physically connected to the heat sink, wherein the reflective pillar of the reflective frame is connected to the secondary optical component, the secondary optical component is doped with a plurality of diffusion particles and has a first optical surface and a second optical surface, the first optical surface connects the heat sink and the second optical surface, an absolute value of a slope of a tangent line of any point on the first optical surface with respect to the heat sink is substantially constant, and an absolute value of a slope of a tangent line of any point on the second optical surface is gradually larger and then gradually smaller along a direction away from the heat sink.

* * * * *